US007594587B2

(12) United States Patent
Auer

(10) Patent No.: US 7,594,587 B2
(45) **Date of Patent: *Sep. 29, 2009**

(54) REMOVABLE LOCKING CONTAINER COVER

(75) Inventor: Robert T. Auer, East Stroudsburg, PA (US)

(73) Assignee: Stull Technologies, Inc., Somerset, NJ (US)

( * ) Notice: Subject to any disclaimer, the term of this patent is extended or adjusted under 35 U.S.C. 154(b) by 291 days.

This patent is subject to a terminal disclaimer.

(21) Appl. No.: 11/542,547

(22) Filed: Oct. 3, 2006

(65) Prior Publication Data

US 2007/0095845 A1 May 3, 2007

Related U.S. Application Data

(60) Provisional application No. 60/732,811, filed on Nov. 2, 2005.

(51) Int. Cl.
*B65D 45/22* (2006.01)
*B65D 41/16* (2006.01)

(52) U.S. Cl. ..... 220/326; 220/784; 220/792; 220/254.3; 215/216

(58) Field of Classification Search ..... 220/254.3, 220/326, 784, 792; 215/221, 330, 331, 216
See application file for complete search history.

(56) References Cited

U.S. PATENT DOCUMENTS

| | | | | |
|---|---|---|---|---|
| 247,547 | A | 9/1881 | Eisemann | |
| 471,911 | A | 3/1892 | Sutro | |
| 1,482,931 | A | 2/1924 | Keehn | |
| 2,205,685 | A | 6/1940 | Conner | |
| 2,695,806 | A | 11/1954 | Balint | |
| 3,642,161 | A | 2/1972 | Stroud | |
| 3,688,942 | A | 9/1972 | Mitchelle et al. | |
| 3,703,975 | A | 11/1972 | Wittemer | |
| 3,868,041 | A | 2/1975 | Knize | |
| 3,885,712 | A | 5/1975 | Libit | 222/153.14 |
| 3,964,634 | A | 6/1976 | Jasinski et al. | |
| 4,014,452 | A | 3/1977 | Galer | |
| 4,079,857 | A | 3/1978 | Crisci | |
| 4,119,239 | A | 10/1978 | Anderson | 220/324 |
| 4,209,107 | A | 6/1980 | Crisci | |

(Continued)

FOREIGN PATENT DOCUMENTS

| | | |
|---|---|---|
| WO | WO 91/02685 | 3/1991 |

*Primary Examiner*—Anthony D Stashick
*Assistant Examiner*—James N Smalley
(74) *Attorney, Agent, or Firm*—Drinker Biddle & Reath LLP

(57) ABSTRACT

A container cover for use with a container having a neck with a rim. The cover includes a lid with a spout hole, a skirt extending downward from the circumference of the lid, a concentric plug seal extending downward from the lid inside the skirt, a spout hole door hingeably connected to the lid, and at least one non-flexing lock and one flexing lock, each having an inwardly projecting wedge, which lock the cover in place on the container by engaging the bead ring. The nonflexing lock wedge is preferably shaped as a truncated teardrop and positioned so as to facilitate removing the lid. When the cover is locked on the container, the plug seal provides a seal against the inside of the container neck. The spout door seals the spout hole when closed and prevents unlatching of the flex lock when open.

22 Claims, 9 Drawing Sheets

U.S. PATENT DOCUMENTS

| | | | | |
|---|---|---|---|---|
| 4,210,258 | A | 7/1980 | von Holdt | |
| 4,349,119 | A | 9/1982 | Letica | |
| 4,387,828 | A | 6/1983 | Yates, Jr. | |
| 4,480,762 | A | 11/1984 | Thomas | |
| 4,526,289 | A | 7/1985 | Schiemann | 220/304 |
| 4,579,257 | A | 4/1986 | Brandlein | 222/192 |
| 4,676,388 | A | 6/1987 | Kuboshima | 215/217 |
| 4,687,112 | A | 8/1987 | Swartzbaugh | |
| 4,718,571 | A | 1/1988 | Bordner | |
| 4,752,014 | A | 6/1988 | House et al. | 215/216 |
| 4,949,865 | A | 8/1990 | Turner | 220/713 |
| 5,042,683 | A | 8/1991 | Shaw et al. | |
| 5,232,116 | A | 8/1993 | Baxter | |
| 5,275,287 | A * | 1/1994 | Thompson | 215/344 |
| 5,292,017 | A | 3/1994 | Reifers | |
| 5,310,981 | A | 5/1994 | Samoff et al. | 219/731 |
| 5,375,730 | A | 12/1994 | Bahr et al. | 220/324 |
| 5,449,077 | A | 9/1995 | Seidler | |
| 5,603,421 | A | 2/1997 | Opresco | |
| 5,706,963 | A | 1/1998 | Gargione | |
| 5,769,258 | A | 6/1998 | Harrison et al. | 220/203.1 |
| 5,865,330 | A | 2/1999 | Buono | |
| 5,881,907 | A | 3/1999 | Schutz | |
| 5,908,125 | A | 6/1999 | Opresco | 215/216 |
| 5,927,526 | A | 7/1999 | Herr | |
| 6,036,036 | A | 3/2000 | Bilani et al. | |
| 6,056,138 | A | 5/2000 | Chen | |
| 6,202,869 | B1 | 3/2001 | Sullivan | |
| 6,296,130 | B1 | 10/2001 | Forsyth et al. | |
| 6,364,152 | B1 | 4/2002 | Poslinski et al. | |
| 6,431,385 | B1 | 8/2002 | Palmer | 220/324 |
| 6,439,409 | B1 | 8/2002 | Dressel et al. | |
| 6,460,716 | B1 | 10/2002 | Wong | |
| 6,575,323 | B1 | 6/2003 | Martin et al. | |
| 6,612,450 | B1 | 9/2003 | Buono | 215/228 |
| 6,783,019 | B2 * | 8/2004 | Zettle et al. | 220/254.3 |
| 2003/0085227 | A1 | 5/2003 | Azzarello | |
| 2004/0195241 | A1 * | 10/2004 | Stull et al. | 220/326 |

* cited by examiner

REMOVABLE LOCKING CONTAINER COVER

CROSS-REFERENCE TO RELATED APPLICATION

This application claims the benefit of U.S. Provisional Patent Application No. 60/732,811, filed on Nov. 2, 2005, which is hereby incorporated by reference in its entirety.

FIELD OF THE INVENTION

The present invention relates generally to removable covers for containers, and more particularly, to removable and reusable covers with a pour spout for use with microwavable containers.

BACKGROUND OF THE INVENTION

It is known to provide a removable cover for a container, such as a container of food or drink. Many such containers can be placed in a microwave oven to heat its contents. The cover or closure functions to prevent the contents of the container from spilling when the container is moved, or splattering when being heated in the microwave. However, many prior art container covers have suffered from deficiencies. Depending on their construction, they may be difficult to put on or to remove, or may be too easily removed, thereby resulting in inadvertent removal of the cover.

It is also known to have a cover with a hole in it, such as a spout, for pouring out the container contents, or for drinking the contents directly from the container. However, a number of prior art container covers provide a poor seal between the cover and the container, such that when the container contents are poured out some of the contents leak from between the container and the cover.

It is desirable to provide a cover which is easier to put onto and take off of a container, inhibits inadvertent removal, and that seals more dependably.

SUMMARY OF THE INVENTION

The invention is directed to a container cover for use with a container having a neck with an outer bead ring or lip. In one aspect, the container cover comprises a lid with a spout hole (or pour spout), a skirt extending downward from the circumference of the lid, a concentric plug seal extending downward from the bottom of the lid disposed inside the skirt, a spout door hingeably connected to the top of the lid, and a plurality of locks each having an inwardly projecting wedge, which hold the cover in place on the container by engaging the container neck bead ring.

When the cover is installed on the container, the wedges on the inside of the skirt engage the outside of the container neck, and the plug seal sealingly engages the inside of the container neck. In an embodiment, the lid is circular and fits on a container neck with a circular cross section. The cover has a flexing lock disposed at the rear of the lid, and two non-flexing locks disposed on the opposite side of the cover from the flexing lock.

A spout plug seal is located on the bottom of the spout door and is designed to snap into place in the spout hole, thereby sealing the spout hole. A lifting tab on the front edge of the spout door is used to unsnap or release the door and open the spout hole. When open, the lifting tab on the spout door preferably snaps into place under a nub projecting from the inside of the flexing lock, thereby holding the door in an open position and also preventing the flexing lock from being inadvertently unlatched.

Other objects, aspects and advantages of the present invention will become apparent to those skilled in the art upon reading the following detailed description, when considered in conjunction with the appended claims and the accompanying drawings briefly described below.

BRIEF DESCRIPTION OF THE DRAWINGS

For the purpose of illustrating the invention, there is shown in the drawings embodiments that are presently preferred; it being understood, however, that this invention is not limited to the precise arrangements and constructions particularly shown. In the drawings.

DETAILED DESCRIPTION OF THE PREFERRED EMBODIMENTS

Figure 1:
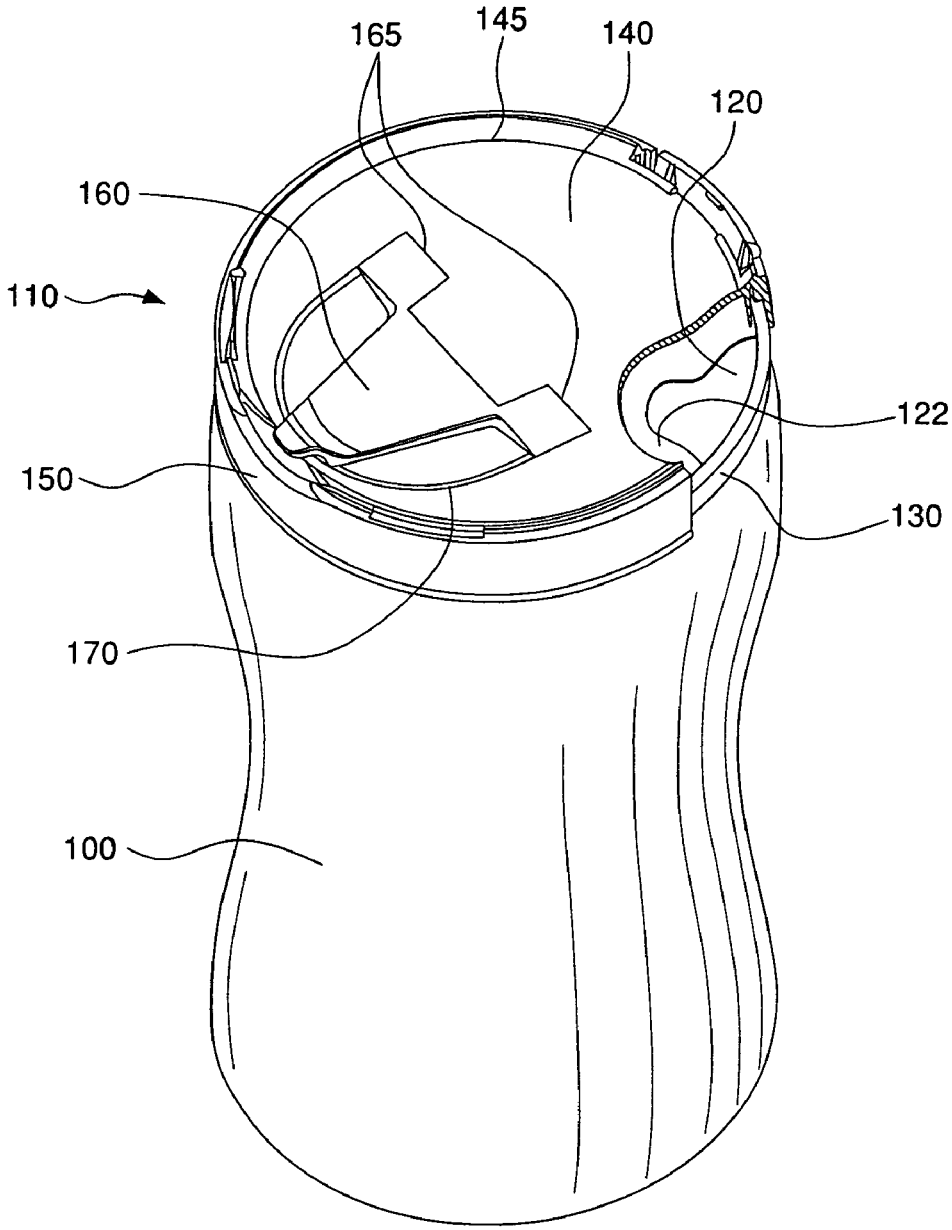
FIG. 1 is a partial cutaway perspective view of a container cover according to a preferred embodiment of the present invention, shown with the spout door closed, installed on a container.

Referring now to the drawings wherein like reference numerals identify like elements, FIG. 1 shows a container 100 in combination with a removable locking container cover 110 according to the present invention. The container 100 has an upper end 120 having an open mouth. A removable top or shipping seal 122, such as a peel-off top with a ring-like opening tab, may be sealed to a rim or outer edge of the container 100 to prevent the contents of the container from spilling. The user removes the top prior to use to expose the contents (not shown) of the container 100. With the top removed, the container cover 110 may be attached or reattached to the container upper end 120 before moving or heating the container to reduce the risk of the contents spilling while the container is carried or splattering when the container is heated.

The container 100 may be of any size or shape and may be fabricated from any of a variety of materials. Preferably, the container 100 contains food products which are heated in a microwave oven prior to consumption. Therefore, container 110 is preferably fabricated from a material suitable for use with food products and for heating in a microwave, for example a thermoplastic material such as polypropylene formed by injection molding. The container 100 preferably includes a neck or rim with a protruding lip having an outer bead ring 130, or similar structure proximate to its upper end 120. The outer bead ring 130 may be disposed directly adjacent to the upper end 120 of the container 100 or in close proximity thereto. While the container 100 and cover 110 are illustrated as each having a substantially circular shape, it will be appreciated that the teachings of the invention are applicable to a variety of other shapes. The following description and embodiments of the invention are not intended to describe all cover/container combinations, but are merely illustrative of how the teachings of the present invention may be employed in the context of a preferred container configuration.

Referring to FIG. 1, the container cover 110 includes a lid 140, having a top, a bottom, a circumferential edge 145, and a spout hole. When installed on the container, the top of the lid faces away from the container, and the bottom of the lid faces into the container. The cover also includes a skirt 150 extending downward from or near the circumferential edge of the lid 140. The skirt 150 has an inner surface (or wall) and an outer surface (or wall). When installed on the container, the outer wall faces away from the container, and the inner wall faces toward the container, and is preferably shaped to fit snugly around the outside of the container neck and/or outer bead ring.

Container cover 110 also includes a spout door 160. The spout door is attached to the top of the lid preferably via at least one hinge 165. The spout door has an edge 170, and a point on the edge furthest from the hinge defines a front edge of the door. The door is shown in FIG. 1 in its closed position. When the door is in its closed position, the top of the door faces the same direction as the top of the lid, and the bottom of the door faces the same direction as the bottom of the lid. The hinge is disposed on the lid so that the spout hole is completely covered by the door when the door is in its closed position. A point on the circumference of the lid nearest the front edge of the door when the door is in its closed position defines the front of the lid, and a point on the circumference of the lid opposite the front of the lid defines the rear of the lid.

Figure 2A:
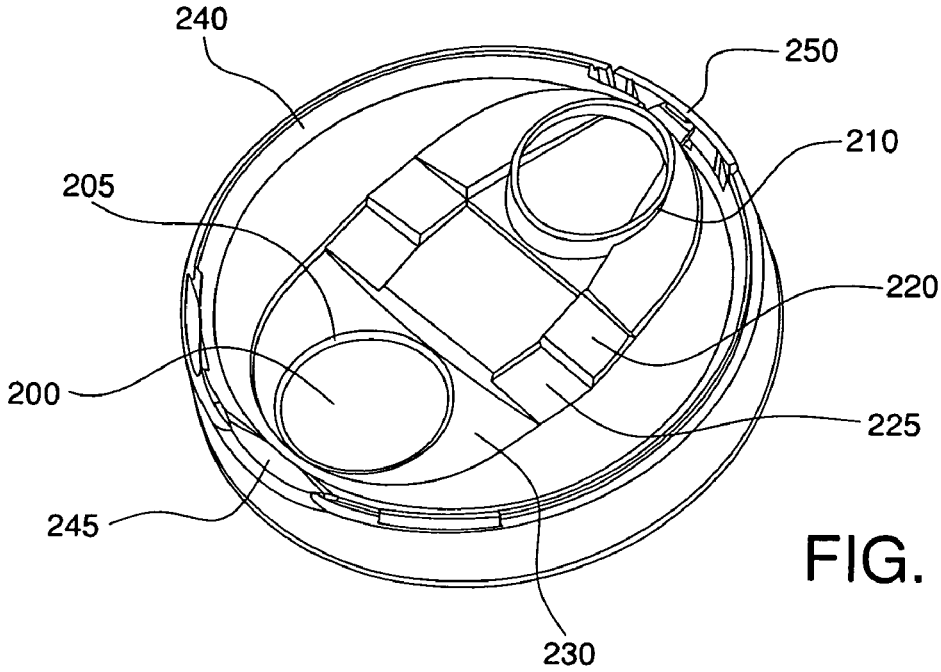
FIGS. 2A and 2B are top and bottom perspective views, respectively, of the cover of FIG. 1, shown with the spout door open, without the container.

FIG. 2A is a top perspective view of the cover of FIG. 1, shown with the door in its open position, uncovering spout hole 200 with edge 205, and showing the bottom of the spout door. The bottom of the spout door comprises a spout plug seal 210 shaped to fit snugly and sealingly in the spout hole when the door is in its closed position. The hinge 165 is preferably a split level living hinge (e.g., molded integrally to the lid.) Recessed area 225 in the top of the lid is shaped so that when the door is in a closed position, the bottom surface of the door 220 fits into a homologously shaped recess on the lid 225. The portion of the top of the lid adjacent to the spout hole preferably has a concave or sloped surface 230 to help control any spillage of the contents of the container. The container cover has a lip 240 extending upward from the circumferential edge of the lid, which also helps control any spillage of the contents of the container. The lip 240 has a reduced height or notch 245 at the part of the circumference closest to the spout hole, to help control the flow of the contents when being poured out through the spout hole 200 or when the user drinks directly from the spout hole.

The container cover is held onto the container by a plurality of locks, one of which is a flexing lock 250 at the rear of the lid. The locks engage the outer bead ring on the neck of the container, as will be described hereinafter.

Figure 2B:
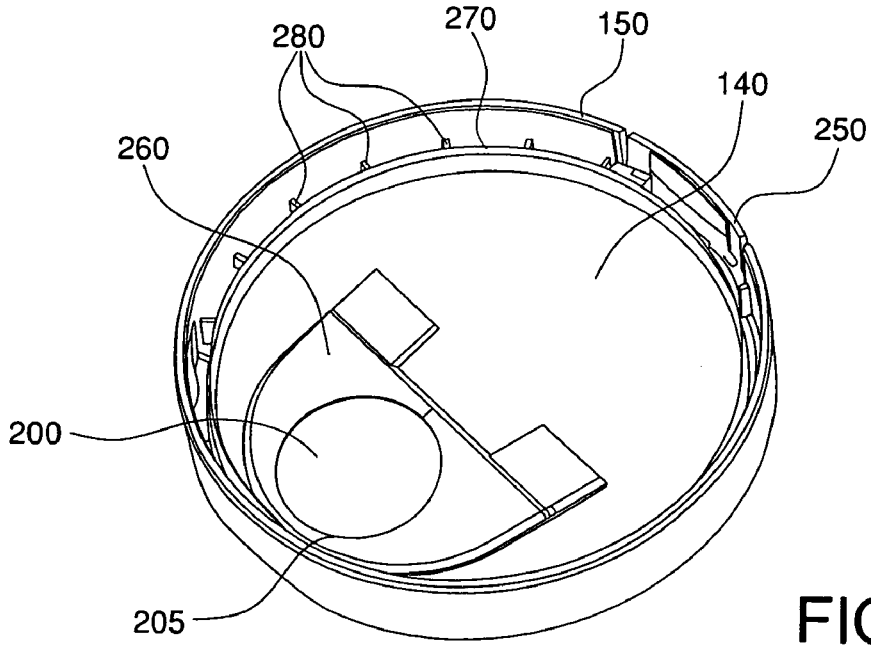

FIG. 2B is a bottom perspective view of the cover of FIG. 1. The bottom of the lid 140 has a protruding area 260 with a profile similar to the profile of the spout door in its closed position. Plug seal 270 is preferably formed concentrically to the skirt 150 and has a smaller diameter than the skirt. The plug seal 270 extends from the bottom of the lid and preferably connects along its entire length to the bottom of the lid. The plug seal has an outer wall shaped to preferably fit snugly and sealingly against the inside of the neck or rim of the container. A plurality of stop ribs 280 preferably extend from the inside of the skirt and/or the bottom of the lid. The stop ribs are located so that, when the cover is installed on a container, the stop ribs touch the top of the container neck limiting the downward movement of the cover onto the container.

Figure 3A:
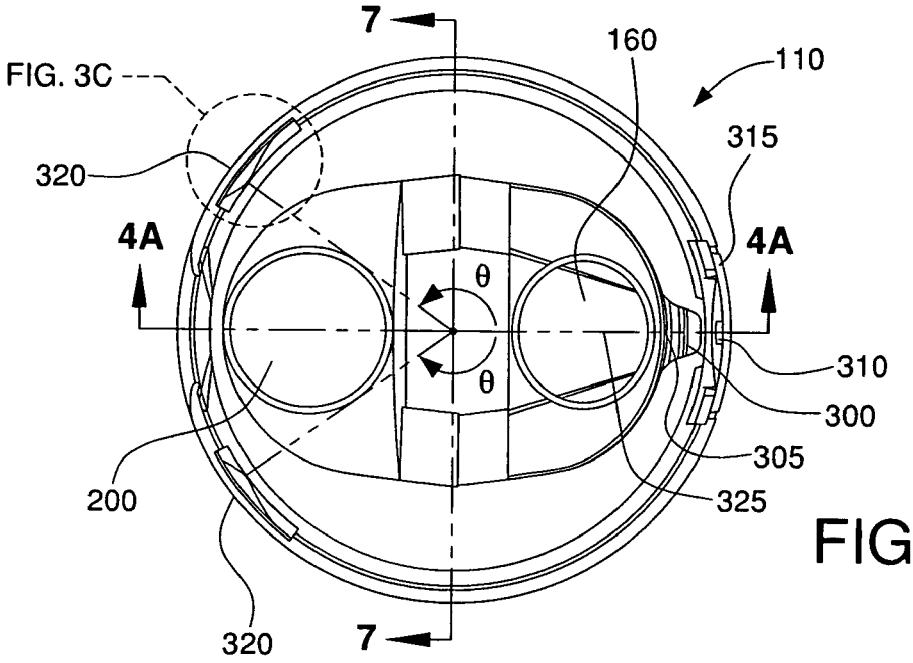
FIGS. 3A, 3B and 3C are a top view of the cover of FIG. 1, an enlarged view showing the flexing lock, and an enlarged view showing a non-flexing lock, respectively.

FIG. 3A is a top view of the cover 110 of FIG. 1 with the door 160 in a mostly open position. A lifting tab 300 is located on the front edge 305 of the door. When the door is in its fully open position, the end of the lifting tab 300 engages a nub 310 that protrudes from the inside of a flex lock panel 315, so that the door 160 is held in its open position by the nub 310 and the lifting tab 300 prevents the flex lock panel 315 from moving into an unlatched position. There is at least one and more preferably at least two non-flexing locks 320 located on or near the front of the lid. In the illustrated embodiment, each non-flexing lock 320 is a wedge formed in the shape of a truncated tear drop. It should be readily apparent that other shapes could be used, such as a bulbous protrusion. The radially inmost point of each wedge is preferably located at an angle θ from a longitudinal axis 325, which is preferably in a range of approximately 135 degrees to approximately 155 degrees, and is most preferably 144 degrees. The wedges 320 are preferably equally spaced from and on opposite sides of the longitudinal axis 325. As will be discussed in more detail below, there is also at least one flexing lock located on the rear of the lid. The flexing lock also includes a wedge 350. The wedge 350 preferably is located on the longitudinal axis 325.

Figure 4A:
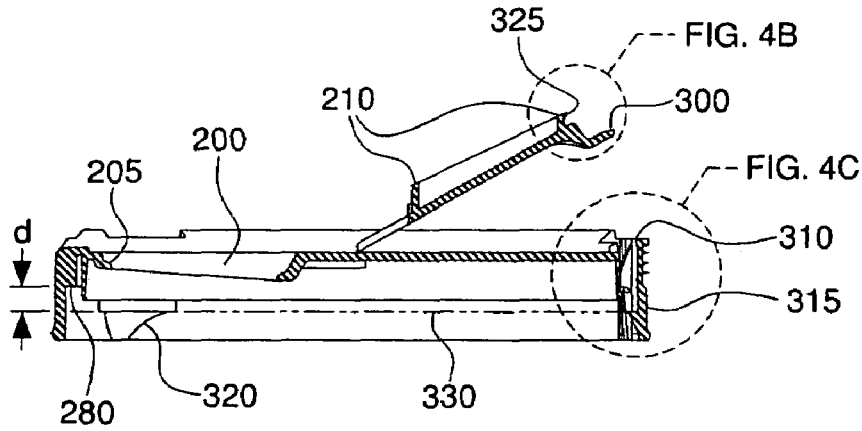
FIGS. 4A, 4B and 4C are a side cross-sectional view of the cover of FIG. 1, an enlarged view of the front of the spout door showing the lifting tab and the spout door plug seal snap, and an enlarged view showing the flexing lock, respectively.

FIG. 4A is a side cross-sectional view of the cover of FIG. 1 taken along lines 4A-4A in FIG. 3A. This figure more clearly illustrates the door in a mostly open position. As the door swings into its fully open position, the lifting tab 300 will engage the nub 310 on the inside of the flex lock panel 315, holding the door in its open position, and preventing the flexing lock from inadvertently being unlatched. Spout plug seal 210 is shown on the bottom of the door (facing upward in FIG. 4A). As the door swings into its fully closed position, the spout plug seal 210 will snugly and sealingly fit against the edge 205 of the spout hole 200, and spout plug seal snap 325 will engage the edge 205 of the spout hole.

The level of the top of the wedges of the flexing and non-flexing locks (i.e., the vertical location of the tops of the wedges on the skirt) is indicated by dashed line 330. The bottom of a stop rib 280 is also visible. The distance d between the bottom of the stop ribs 280 and the top of the lock wedges 330 is sized so that when the cover is installed on a container having a bead ring 130 on its neck, the bottom of the stop ribs 280 touches the top of the neck or the bead ring 130, and the lock wedge engages the bottom of the container bead ring 130, thereby locking the container cover in place.

Figure 5:
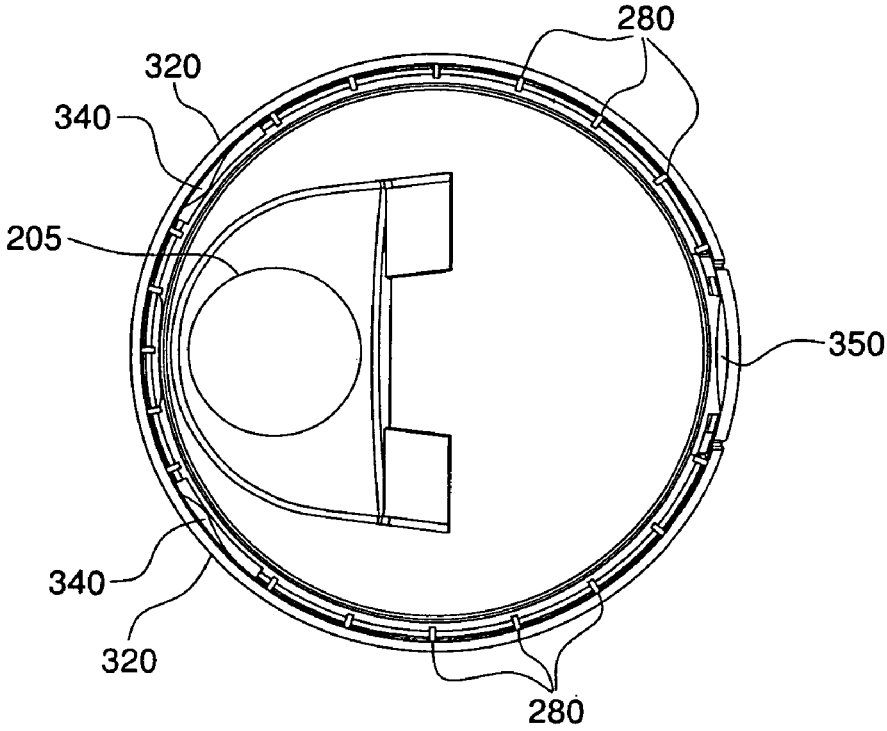
FIG. 5 is a bottom view of the cover of FIG. 1.

FIG. 5 is a bottom view of the cover of FIG. 1. The truncated tear drop-shaped wedges 340 of the two non-flexing locks 320 are visible from the bottom in the figure, with the feathered part of the wedges pointing toward the flexing lock. The wedge 350 of the flexing lock is also visible, as are the stop ribs 280 extending from the inside of the skirt.

Figure 6A:
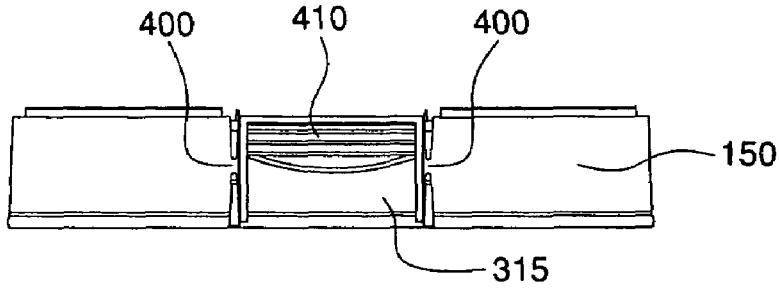
FIGS. 6A and 6B are a rear view of the cover of FIG. 1, and an enlarged view showing the flexing lock, respectively.
Figure 6B:
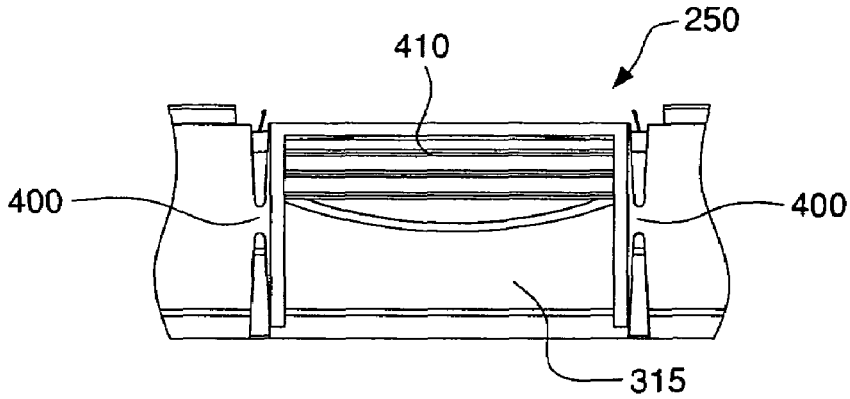

FIG. 6A is a rear view of the cover according to one embodiment of the invention, and FIG. 6B is an enlarged rear view of the cover, showing the flexing lock 250. The flexing lock comprises a flex lock panel 315 preferably of substantially the same thickness as the skirt 150, disposed so that it does not interfere with the plug seal when the cover is installed. The lock panel has an inside, an outside, a top edge, a left edge and a right edge. In the illustrated embodiment, an elastically deformable hinge attaches the flex lock panel to the skirt. More particularly, a deformable pivot bar 400 is formed on each of the left and right sides of the flex lock panel 315 at an intermediate point along the height of the panel. The pivot bars are connected to the skirt. Forming the pivot bars as part of the skirt and not attached directly to the plug seal 270 results in the flex lock remaining comparatively cooler during heating since the flex lock is not in direct contact with the interior of the container.

The panel, pivot bars and the skirt are all preferably formed as an integral injection molded unit. The outside surface of the flex lock panel 315 preferably has a textured area 410 substantially adjacent to the top edge of the panel. The textured area helps keep the fingers of a user from slipping, such as when removing the cover from the container.

Figure 3B:
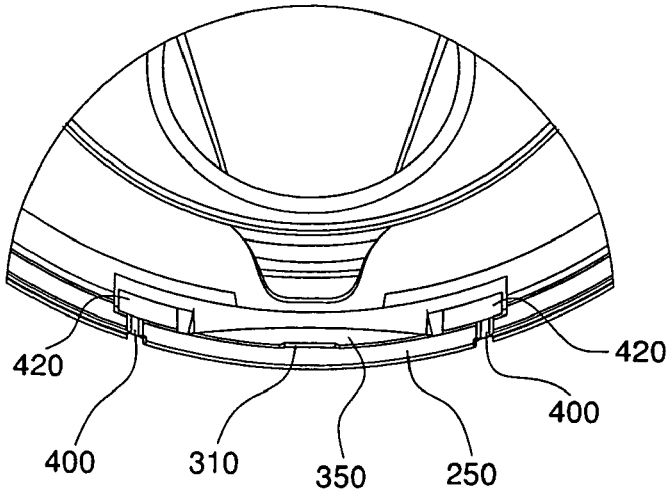

FIG. 3B is an enlarged top view of the cover, showing the flexing lock. The locking wedge 350 extends inward from an inside surface of the flex lock panel 315. In a latched position, the locking wedge engages the lower edge of outer bead ring of the container. In an unlatched position, the wedge 350 is released from the outer bead ring. The nub 310 extends from the top of the inside surface of the flex lock panel. Pawls 420 may be formed on the back of the pivot bars 400 at a location which allows them to contact the top surface of the container neck when the flexing lock is latched. This provides additional support for the flex lock panel when it is actuated from the latched to the unlatched position since the pawls push on the top surface of the container neck, thereby assisting in the pivoting of the flex lock panel.

Figure 4B:
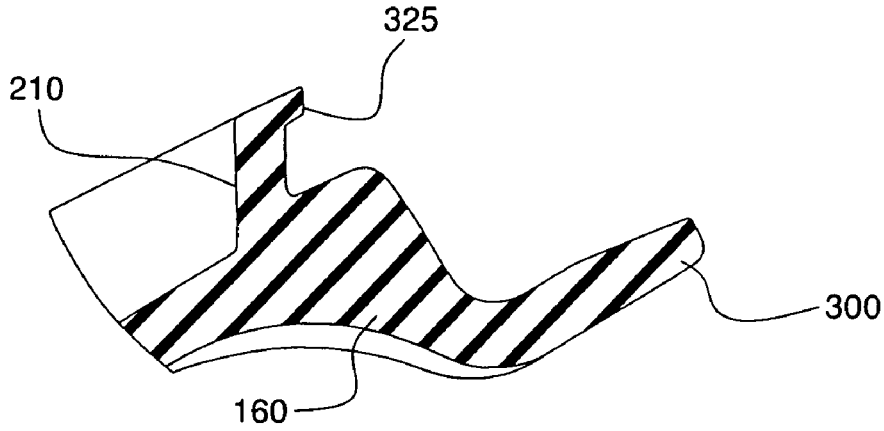

FIG. 4B is an enlarged cross-sectional view of the tip end portion of the spout door 160. The lifting tab 300 extends from the front edge of the door, and is designed to engage with the nub 310 (FIG. 4C) on the inside of the flex lock panel when the door is in its open position, thereby holding the door open, as hereinbefore described. The spout plug seal snap 325 protrudes from the spout plug seal 210, and engages an edge of the spout when the door is in its closed position, thereby holding the door closed and sealing the spout hole shut, as hereinbefore described.

Figure 4C:
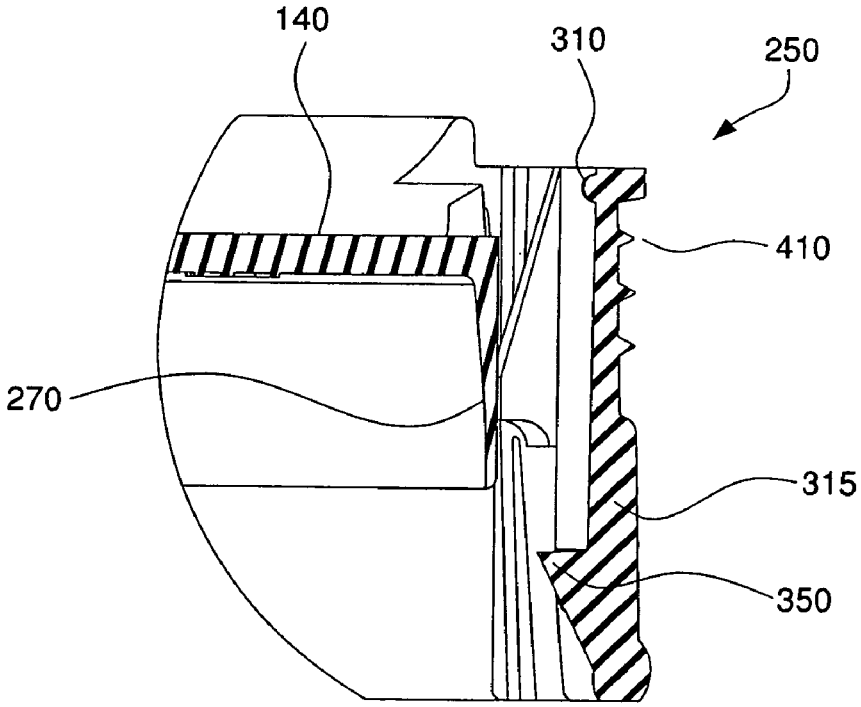

FIG. 4C is an enlarged cross-sectional view of the flexing lock 250. The nub 310 is shown extending inward from the top of the inside surface of the flex lock panel 315. The textured area 410 is shown on the top of the outside surface of the flex lock panel 315. The locking wedge 350 extends inward from the bottom of the inside surface of the flex lock panel 315.

Figure 3C:
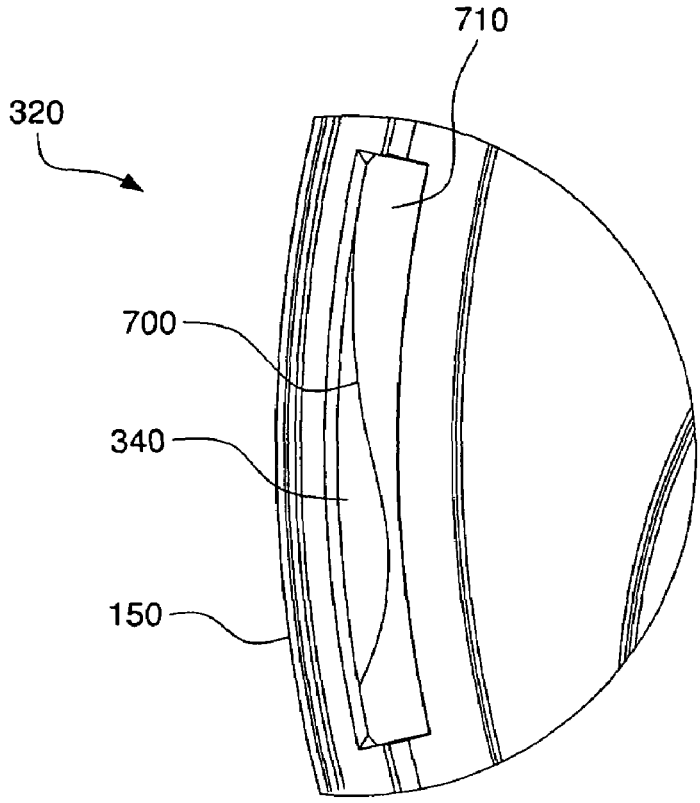

FIG. 3C is an enlarged partial top view of the cover, showing a non-flexing lock 320. As described above, the non-flexing lock 320 includes the locking wedge 340 which extends from the inner wall of the skirt 150. The wedge 340 can more clearly be seen in this figure in the shape of a truncated tear drop, with the feathered edge 700 extending circumferentially away from the bulbous end (and from the spout.) An open slot 710 is preferably formed between the circumference of the lid and the top circumference of the skirt, substantially adjacent to the non-flexing lock wedge 340.

Figure 7:
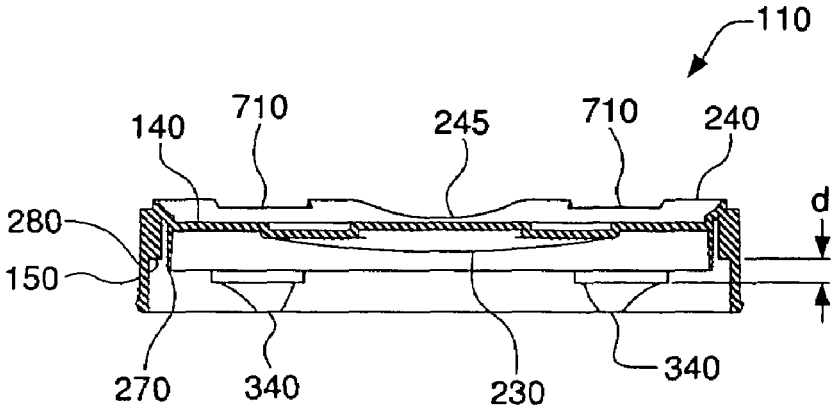
FIG. 7 is a cross-sectional view of the cover.

FIG. 7 is a cross-sectional front view of cover 110. As hereinbefore described, the open slots 710 are substantially adjacent to the non-flexing lock wedges 340. The plug seal 270 extends from the bottom of the lid 140, concentric with the skirt 150 which extends downward from the circumference of the lid. The stop ribs 280 extend from the skirt and the lid, and do not interfere with the plug seal 270 when the cover is installed on a container. Distance d between the bottom of the stop ribs 280 and the top of wedges 340 is sized so that when the cover is installed on a container having a bead ring 130 on its neck, the bottom of the stop ribs 280 touches the top of the neck or bead ring 130, and the wedges engage the bottom of the bead ring 130, thereby locking the container cover 110 in place on the container 100. Although the illustrated embodiment includes open slops 710, it should be readily apparent that the slots are not necessary in the cover.

The container cover of the present invention is preferably formed from thermoplastic material such as polypropylene in a one piece construction using an injection molding process. The container cover preferably has a hinged drink door and three integral locks. The cover is preferably microwavable and easily removed and reapplied to the container by the user. It is contemplated that the cover can be locked onto the top lip of the container during an assembly process at the factory, keeping the top surface of the container completely sealed, clean and dry during shipping and storage. To remove the cover cap, the user presses inward on the textured portion of the flex lock panel of the flexing lock. This mechanical action moves the locking wedge lock away from the container bead ring, while the pawls on the pivot bars push down on the top of the container neck, making it possible to lift the back section of the cover. Simultaneously as the user lifts up on the back section of the cover, the cover is moved forward in an arc, disengaging the two front non-flexing locks.

After the user has removed the cover, the user opens the container, such as by pulling upward on the now exposed metal ring tab of a sealed container top, completely separating the top from the container and discarding it. Next the user replaces the cover cap with the door in the open position and places the container with cover into a microwave. When the user places the door into its open position it makes a distinctive snapping sound as the lifting tab engages the nub on the flex lock panel, securing the door in its open position. The door is left open during the microwaving process to vent steam generated in the container by the heating process.

In a preferred container/cover configuration, the container has a circular neck, and the cover has one flexible lock located at the rear of the cover and two non flexing locks, one on each side of the spout. The two non-flexing locks are formed as part of the inner wall of the skirt, and the flexing lock is part of the inner wall of the flex lock panel. This lock approach leaves the plug seal completely free from all connecting obstructions that create unwanted shrinkage and lead to leakage problems. The stop ribs preferably do not touch the plug seal or cause seal distortions. Because of the uninterrupted plug seal, it is completely round and seals 360 degrees against the inside of the neck of the container. Locating the flexible lock on the skirt allows for simple assembly by simply placing the cover over the container and pressing the cover directly down onto the container. When the flexible lock is engaged it makes a distinct snap sound as it slides over the container bead. The locking action can also be felt by the user through the finger tips as it locks over the container bead.

The two non-flexing front locks are shaped as truncated teardrops so that they will slip over the container bead as the cover is removed. The two actions of unlatching the flexing lock and lifting the cover need to be done simultaneously to remove the cover. The feathered end of the teardrop points toward the flexing lock, so that the cover can be peeled off of the container bead. Directing the feathered end of the truncated teardrop toward the flexing lock also creates a smooth entry for the container bead to start and slide over the lock as the cover cap is taken off.

A safety feature of the preferred embodiment is that when the door is placed in its open position, it prevents the flexible lock from being inadvertently unlocked. When the door is placed in its open position, the lifting tab engages a nub on the inner top surface of the flexing lock. This prevents a user from inadvertently depressing the flexing lock and accidentally removing the cover. This reduces the risk of the contents of the container spilling onto the user. The cover can only be unlocked and removed from the container when the door is not in its open position.

Figure 8A:
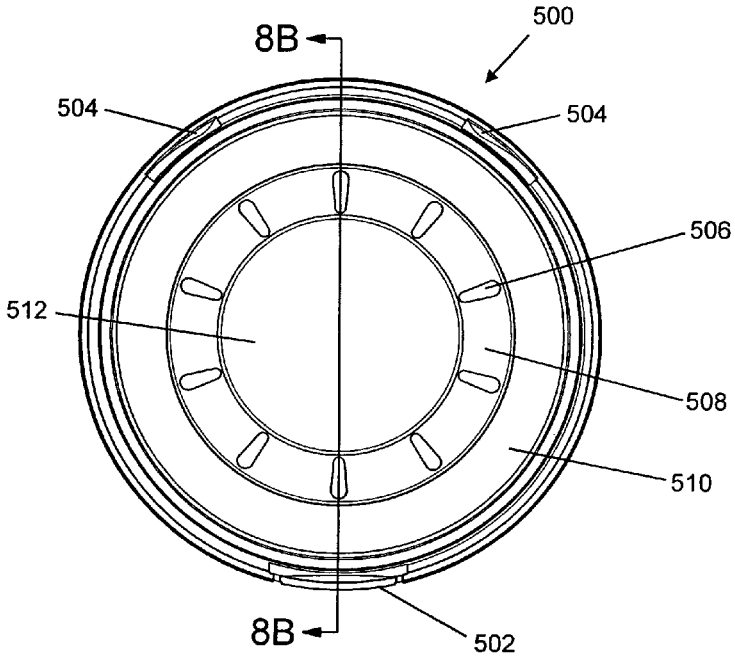
FIGS. 8A and 8B illustrate the top and cross-sectional view of an alternate embodiment of the present invention.
Figure 8B:
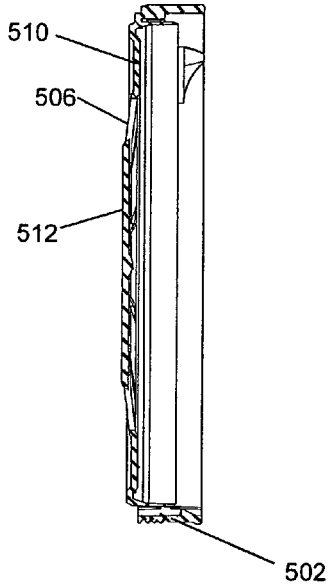

Although the above embodiment included a spout for drinking or pouring the contents of the container, the present invention is not limited to such a configuration. Referring to FIGS. 8A and 8B, an alternate embodiment of the invention 500 is shown that includes the flexible lock 502 and non-flexible locks 504, but does not include a spout. In this embodiment, the cover 500 is simply removed in order to gain access to the contents. As shown, one or more vents 506 are formed in the cover. In the illustrated embodiment, the vents 506 are formed on the sloping transition section 508 between the lower annular surface 510 and the upper surface 512. This configuration is designed to create a chimney effect whereupon the heat generated during cooking is channeled toward the center of the cover escapes through the vents. This keeps the locks and plug seal cooler. Thus, it results in less harm to the user and maintains a better seal.

Figure 9A:
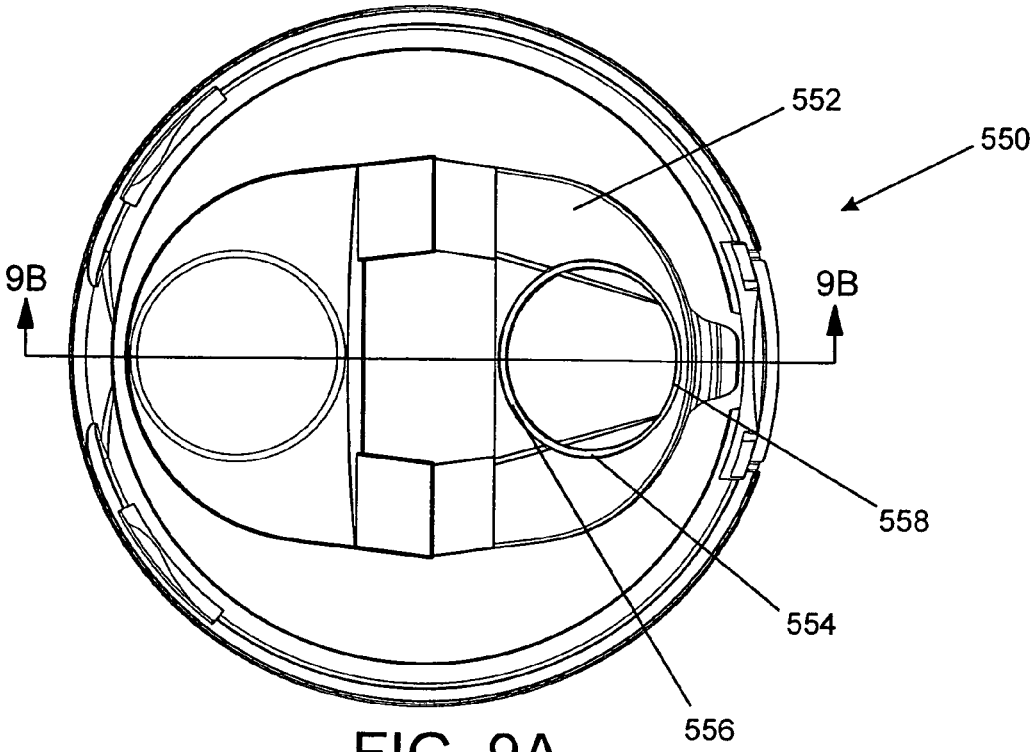
FIGS. 9A and 9B illustrate the top and bottom view of an alternate embodiment of the present invention.
Figure 9B:
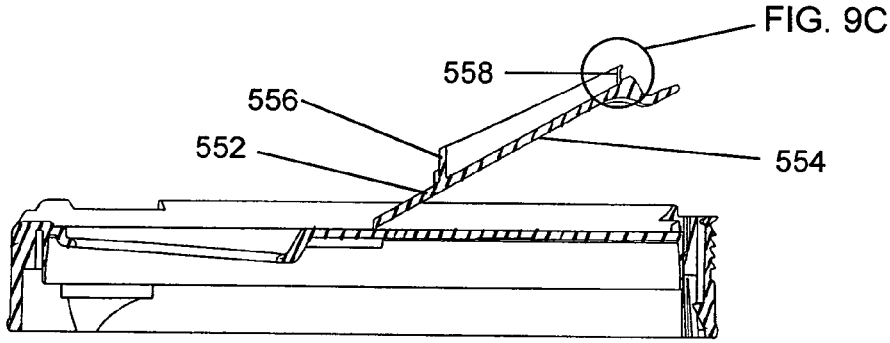
Figure 9C:
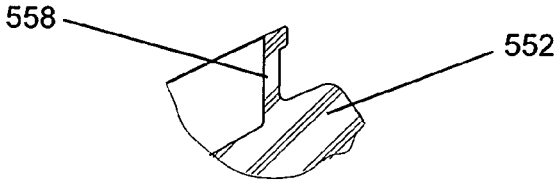
FIG. 9*c* is an enlarged section from FIG. 9B

FIGS. 9A-9C illustrate an alternate embodiment of the invention with the drinking spout. In this embodiment 550, in order to facilitate the opening and closing of the spout door 552, the door plug seal 554 is modified to permit additional flexure. Specifically, the door plug seal wall 554 is formed with a different wall thickness in the front 558 and back 556. Preferably the wall in the back 556 is thicker than the wall in the front 558.

It will be apparent to those skilled in the art that various modifications and variation can be made in the configuration of the present invention without departing from the spirit or scope of the invention. It is intended that the present invention cover such modifications and variations provided they come within the scope of the appended claims or their equivalents.

What is claimed is:

1. A removable locking container cover for covering a container having a neck with an outer bead, the cover comprising:

a lid having a top, a bottom, a circumferential edge, and a spout hole;

a skirt extending downward from the lid at or near the circumferential edge, the skirt having an inner surface and an outer surface, the inner surface shaped to extend around the outside of the container neck;

a plug seal extending from the bottom of the lid and concentric with the skirt, the plug seal having a smaller diameter than the skirt, the plug seal being connected to the bottom of the lid, the plug seal having an inner surface and an outer surface, the outer surface is shaped to fit snugly against the inside of the neck of the container; and a plurality of integral locks, each lock having an inwardly projecting locking wedge configured to engage a bottom edge of the outer bead of the container when the cover is locked onto a container so as to removably hold the cover in place on the container, one of the locks being a flexing lock, and two of the locks are non-flexing locks, the flexing lock and the non-flexing locks each being formed on the inside surface of the skirt, wherein the non-flexing locks are spaced apart from one another and are each formed on the inside surface of the skirt more than 90 degrees from the center of the flexing lock so that no non-flexing lock is located less than 90 degrees from the center of the flexing lock.

2. The container cover of claim 1, further comprising a door hingeably connected to the top of the lid at one end of the door, the door having a front edge located on the opposite side of the door from the hinge, the door having an open position and a closed position, the door adapted to completely cover the spout hole in its closed position.

3. The container cover of claim 2, wherein a portion of the top of the lid adjacent to the spout hole having a concave surface.

4. The container cover of claim 2, wherein the hinge connecting the door to the lid is a living hinge.

5. The container cover of claim 2, further comprising a lip extending upward from the circumference of the lid, the lip having a reduced height at the part of the circumference closest to the spout hole.

6. The container cover of claim 1, wherein the locking wedge of each non-flexing lock includes a bulbous portion extending radially inward from the skirt.

7. The container cover of claim 1, further comprising a plurality of stop ribs connected to the inside of the skirt and to the bottom of the lid, the stop ribs disposed so that when all of the locks engage the outer bead the stop ribs touch the top of the container neck limiting vertical movement of the cover on the container.

8. The container cover of claim 1, wherein the container cover is integrally formed as a single piece of injection molded plastic.

9. A removable locking container cover for covering a container having a neck with an outer bead, the cover comprising:

a lid having a top, a bottom, a circumferential edge, and a spout hole;

a skirt extending downward from the lid at or near the circumferential edge, the skirt having an inner surface and an outer surface, the inner surface shaped to extend around the outside of the container neck;

a plug seal extending from the bottom of the lid and concentric with the skirt, the plug seal having a smaller diameter than the skirt, the plug seal being connected to the bottom of the lid, the plug seal having an inner surface and an outer surface, the outer surface is shaped to fit snugly against the inside of the neck of the container; and a plurality of integral locks, each lock having an inwardly projecting locking wedge configured to engage a bottom edge of the outer bead of the container when the cover is locked onto a container so as to removably hold the cover in place on the container, one of the locks being a flexing lock, and at least one of the locks is a non-flexing lock, the flexing lock and the non-flexing lock each being formed on the inside surface of the skirt; and a door hingeably connected to the top of the lid at one end of the door, the door having a front edge located on the opposite side of the door from the hinge, the door having an open position and a closed position, the door adapted to completely cover the spout hole in its closed position, wherein the locking wedge of each non-flexing lock includes a bulbous portion radially extending inward from the skirt; the non-flexing locks being spaced apart from one another and located on the skirt on opposite sides of the spout; and wherein the flexing lock is located substantially in line with the centerline of the spout.

10. The container cover of claim 9, wherein the flexing lock includes:

a hinged lock panel with an inside surface, an outside surface, a top edge, a left edge and a right edge, the hinged lock having a latched position wherein the hinged lock locking wedge engages the bottom edge of the outer bead, and an unlatched position wherein the hinged lock locking wedge is released from the outer bead; and an elastically deformable hinge comprising a pivot bar on the left side of the panel at a point between the top and bottom edges of the panel, and a pivot bar on the right side of the panel at a point between the top and bottom edges of the panel, each pivot bar connecting the side of the panel to the skirt so as to permit the panel to pivot about the pivot bars.

11. The container cover of claim 10, further comprising:

at least one pivot bar further comprising a pawl projecting away from the inside surface of the panel, the pawl positioned so as to make contact with and push on the top surface of the container neck when the lock is unlatched.

12. The container cover of claim 10, further comprising a textured area on the outside surface of the flex lock panel near the top edge of the panel.

13. A removable locking container cover for covering a container having a neck with an outer bead, the cover comprising:

a lid having a top, a bottom, a circumferential edge, and a spout hole;

a skirt extending downward from the lid at or near the circumferential edge, the skirt having an inner surface and an outer surface, the inner surface shaped to extend around the outside of the container neck;

a plug seal extending from the bottom of the lid and concentric with the skirt, the plug seal having a smaller diameter than the skirt, the plug seal being connected to the bottom of the lid, the plug seal having an inner surface and an outer surface, the outer surface is shaped to fit snugly against the inside of the neck of the container; and a plurality of integral locks, each lock having an inwardly projecting locking wedge configured to engage a bottom edge of the outer bead of the container when the cover is locked onto a container so as to removably hold the cover in place on the container, one of the locks being a flexing lock, and at least one of the locks is a non-flexing lock, the flexing lock and the non-flexing locks each being formed on the inside surface of the skirt, wherein there are two non-flexing locks, and wherein-the locking wedge of each non-flexing lock includes a bulbous portion extending radially inward from the skirt; and wherein each non-flexing lock is located in a range of between approximately 125 degrees to approximately 155 degrees, measured from the center of the flexing lock, on either side of the centerline the lid.

14. A removable locking container cover for covering a container having a neck with an outer bead, the cover comprising:

a lid having a top, a bottom, a circumferential edge, and a spout hole;

a skirt extending downward from the lid at or near the circumferential edge, the skirt having an inner surface and an outer surface, the inner surface shaped to extend around the outside of the container neck;

a plug seal extending from the bottom of the lid and concentric with the skirt, the plug seal having a smaller diameter than the skirt, the plug seal being connected to the bottom of the lid, the plug seal having an inner surface and an outer surface, the outer surface is shaped to fit snugly against the inside of the neck of the container; and a plurality of integral locks, each lock having an inwardly projecting locking wedge configured to engage a bottom edge of the outer bead of the container when the cover is locked onto a container so as to removably hold the cover in place on the container, one of the locks being a flexing lock, and at least one of the locks is a non-flexing lock, the flexing lock and the non-flexing locks each being formed on the inside surface of the skirt, wherein there are two non-flexing locks, and wherein-the locking wedge of each non-flexing lock includes a bulbous portion extending radially inward from the skirt; and wherein each non-flexing locking wedge is substantially in the shape of a truncated teardrop with a feathered edge extending circumferentially away from the front of the lid and located at approximately 144 degrees, measured from the center of the flexing lock, on either side of the centerline of the lid.

15. A removable locking container cover for covering a container having a neck with an outer bead, the cover comprising:

a lid having a top, a bottom, a circumferential edge, and a spout hole;

a skirt extending downward from the lid at or near the circumferential edge, the skirt having an inner surface and an outer surface, the inner surface shaped to extend around the outside of the container neck;

a plug seal extending from the bottom of the lid and concentric with the skirt, the plug seal having a smaller diameter than the skirt, the plug seal being connected to the bottom of the lid, the plug seal having an inner surface and an outer surface, the outer surface is shaped to fit snugly against the inside of the neck of the container;

a plurality of integral locks, each lock having an inwardly projecting locking wedge configured to engage a bottom edge of the outer bead of the container when the cover is locked onto a container so as to removably hold the cover in place on the container, one of the locks being a flexing lock, and at least one of the locks is a non-flexing locks, the flexing lock and the non-flexing locks each being formed on the inside surface of the skirt, wherein there are two non-flexing locks, and wherein the locking wedge of each non-flexing lock includes a bulbous portion extending radially inward from the skirt; and an open slot formed in the lid above the non-flexing locks.

16. A removable locking container cover for covering a container having a neck with an outer bead, the cover comprising:

a lid having a top, a bottom, a circumferential edge, and a spout hole;

a skirt extending downward from the lid at or near the circumferential edge, the skirt having an inner surface and an outer surface, the inner surface shaped to extend around the outside of the container neck;

a plug seal extending from the bottom of the lid and concentric with the skirt, the plug seal having a smaller diameter than the skirt, the plug seal being connected to the bottom of the lid, the plug seal having an inner surface and an outer surface, the outer surface is shaped to fit snugly against the inside of the neck of the container;

a plurality of integral locks, each lock having an inwardly projecting locking wedge configured to engage a bottom edge of the outer bead of the container when the cover is locked onto a container so as to removably hold the cover in place on the container, one of the locks being a flexing lock, and at least one of the locks is a non-flexing lock, the flexing lock and the non-flexing locks each being formed on the inside surface of the skirt; and a door hingeably connected to the top of the lid at one end of the door, the door having a front edge located on the opposite side of the door from the hinge, the door having an open position and a closed position, the door adapted to completely cover the spout hole in its closed position, wherein the door further comprises:

a spout plug seal located on the bottom of the door and shaped to fit snugly in the spout hole, the spout seal having a plug seal snap shaped to removably engage an edge of the spout hole, so that when the plug seal snap engages the edge of the spout hole the spout plug seal sealingly engages the spout hole; and a lifting tab formed on the front edge of the door; and wherein the inside surface of the flex lock panel includes a nub near the top edge and located so as to engage the door lifting tab when the door is in its open position, the nub holding the door in its open position, and the lifting tab inhibiting the flex lock panel from being displaced to its unlatched position.

17. A removable locking container cover for covering a container having a neck with an outer bead, the cover comprising:

a lid having a top, a bottom, a circumferential edge, and a spout hole;

a skirt extending downward from the lid at or near the circumferential edge, the skirt having an inner surface and an outer surface, the inner surface shaped to extend around the outside of the container neck;

a plug seal extending from the bottom of the lid and concentric with the skirt, the plug seal having a smaller diameter than the skirt, the plug seal being connected to the bottom of the lid, the plug seal having an inner surface and an outer surface, the outer surface is shaped to fit snugly against the inside of the neck of the container;

a plurality of integral locks, each lock having an inwardly projecting locking wedge configured to engage a bottom edge of the outer bead of the container when the cover is locked onto a container so as to removably hold the cover in place on the container, one of the locks being a flexing lock, and at least one of the locks is a non-flexing lock, the flexing lock and the non-flexing lock each being formed on the inside surface of the skirt and on different sides of the lid from each other, wherein the flexing lock comprises:

a flex lock panel with an inside surface, an outside surface, a top edge, a left edge and a right edge, the flexing lock having a latched position wherein the flexing lock locking wedge engages the bottom edge of the outer bead, and an unlatched position wherein the flexing lock locking wedge is released from the outer bead; and an elastically deformable hinge comprising a pivot bar on the left side of the panel at a point between the top and bottom edges of the panel, and a pivot bar on the right side of the panel at a point between the top and bottom edges of the panel, each pivot bar connecting the side of the panel to the skirt so as to permit the panel to pivot about the pivot bars; and a door hingeably connected to the top of the lid at one end of the door, the door having a front edge located on the opposite side of the door from the hinge, the door having an open position and a closed position, the door adapted to completely cover the spout hole in its closed position, wherein the door further comprises:

a spout plug seal located on the bottom of the door and shaped to fit snugly in the spout hole; and a lifting tab formed on the front edge of the door;

wherein the inside surface of the flex lock panel includes a nub near the top edge and located so as to engage the door lifting tab when the door is in its open position, the nub holding the door in its open position, and the lifting tab inhibiting the flex lock panel from being displaced to its unlatched position.

18. The container cover of claim 17, further comprising a plurality of stop ribs connected to the inside of the skirt and to the bottom of the lid, the stop ribs disposed so that when all of the locks engage the outer bead the stop ribs touch the top of the container neck limiting vertical movement of the cover on the container.

19. The container cover of claim 17, wherein:

there are two non-flexing locks, the locking wedge of each non-flexing lock including a bulbous portion extending inward from the skirt, the non-flexing locks being located on the skirt on opposite sides of the spout;

the flexing lock is located substantially in line with the centerline of the spout; and each non-flexing lock wedge is substantially in the shape of a truncated teardrop with a feathered edge extending circumferentially away from the front of the lid and located at approximately 144 degrees on either side of the centerline the lid.

20. The container cover of claim 17, wherein the hinge connecting the door to the lid is a living hinge.

21. The container cover of claim 17, further comprising a lip extending upward from the circumference of the lid, the lip having a reduced height at the part of the circumference closest to the spout hole.

22. The container cover of claim 17, wherein the container cover is integrally formed as a single piece of injection molded plastic.

* * * * *